US007793643B2

(12) United States Patent
Chen

(10) Patent No.: US 7,793,643 B2
(45) Date of Patent: Sep. 14, 2010

(54) HIGH ENTERTAINING EJECTING TOY

(76) Inventor: Willy Chen, 235 Chung-Ho Box 8-24, Taipei (TW)

( * ) Notice: Subject to any disclaimer, the term of this patent is extended or adjusted under 35 U.S.C. 154(b) by 234 days.

(21) Appl. No.: 12/243,939

(22) Filed: Oct. 1, 2008

(65) Prior Publication Data

US 2010/0078002 A1 Apr. 1, 2010

(51) Int. Cl.
*F41B 11/00* (2006.01)

(52) U.S. Cl. ..... 124/65

(58) Field of Classification Search ..... 124/65–68
See application file for complete search history.

(56) References Cited

U.S. PATENT DOCUMENTS 2,900,972 A * 8/1959 De Loss et al. ..... 124/63
3,342,171 A * 9/1967 Ryan et al. ..... 124/55
3,369,609 A * 2/1968 Fogelgren ..... 169/74
4,774,928 A * 10/1988 Kholin ..... 124/75

* cited by examiner

*Primary Examiner*—Troy Chambers

(57) ABSTRACT

An ejecting toy mainly includes a cylinder body with a receiving chamber. A front end of the cylinder body is covered by a front cover. A vent hole is formed at a middle position of the front cover and at least one air inlet hole is formed at a periphery of the front cover. A front end of the vent hole is sealed by an elastic object. A rear end of the front cover is arranged by a valve, a periphery of the valve has a diaphragm portion with flexibility which is capable of sealing or unsealing the air inlet hole while suffering a force. A handle has a rod body having a piston in a front end of the rod body. The piston can slide back and forth inside the receiving chamber. When the handle is pulled backwards, the diaphragm portion will deform to unseal the air inlet hole to inflow air into the receiving chamber. When the handle is push forwards, the diaphragm portion will deform to seal the air inlet hole so that the pressurized air can only be vented from the vent hole thus the elastic object sealed the vent hole will be ejected out. A shooting activity is thus performed and enjoyed.

10 Claims, 7 Drawing Sheets

HIGH ENTERTAINING EJECTING TOY

FIELD OF THE PRESENT INVENTION

The present invention relates to toy, and in particular to a high entertaining ejecting toy capable of ejecting an elastic object by pressurized air which is sucking from atmosphere and being properly pressurized.

DESCRIPTION OF THE PRIOR ART

There are plenty of kinds of toy nowadays, but toys which are interactive, dynamic, being popular among children and adults, and also safe are few.

Such toys like water guns or swing toys are common and already popular for a period. For children, they need more special and creative toys to draw their interest of playing. Therefore, how to create new idea of playing is the most important object in this business.

SUMMARY OF THE PRESENT INVENTION

Accordingly, the primary object of the present invention is to provide an ejecting toy. Except a prior water gun, the present invention is to create a new idea like an air gun and to create pleasure of operating, shooting, and also to ensure the safety of playing so as to raise the additional value of the product.

The ejecting toy according to the present invention can be easily performed by a user to shoot a safe elastic object by pulling and pushing the handle. The operation is easy and fast, thus user will enjoy the pleasure of operating and flying. Through the wings formed on an elastic body for stabilizing the flying of the elastic object, fun of aiming and shooting is provided. Because of the soft material of the structure, the safety of the playing is well ensured.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
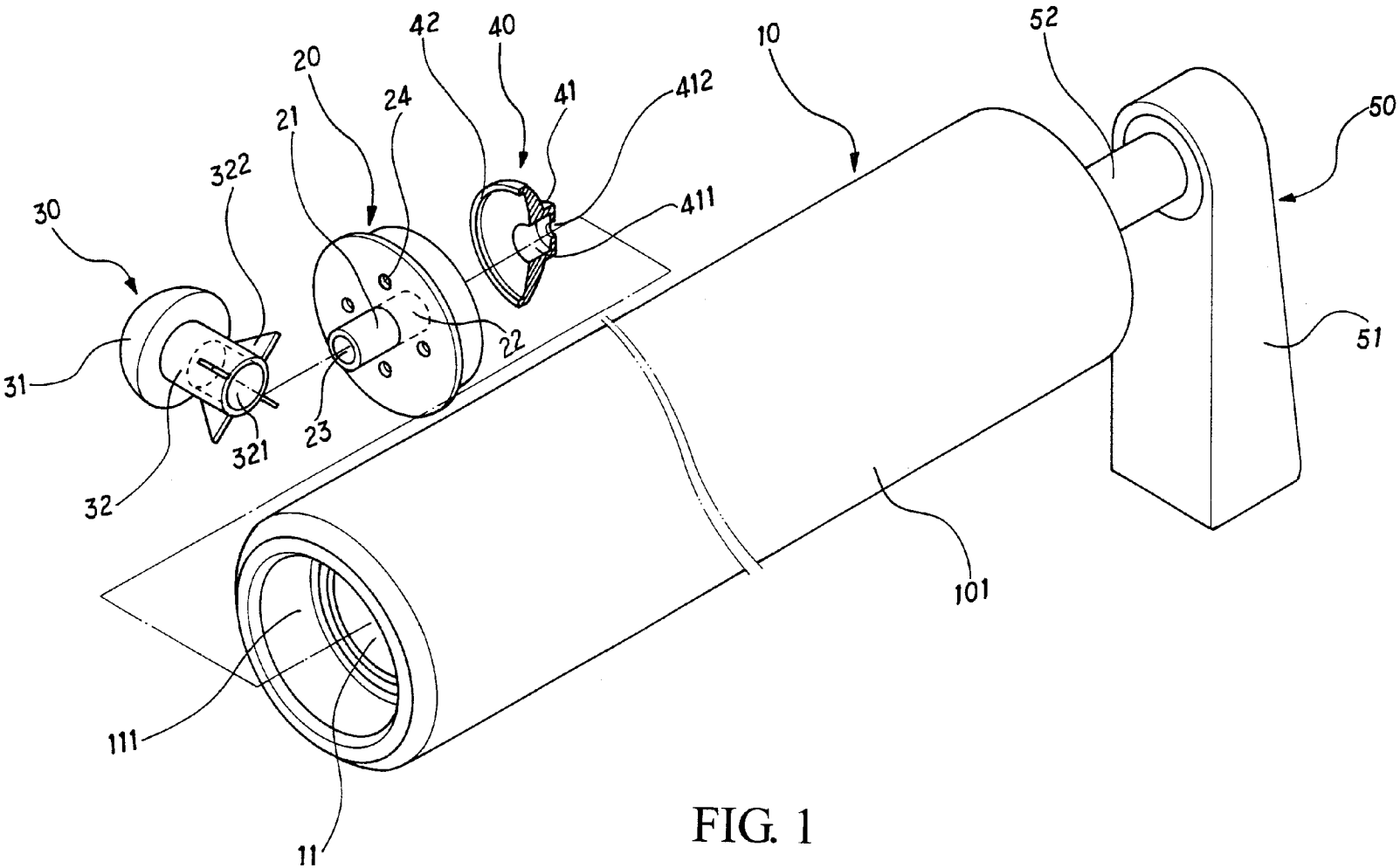
FIG. 1 is an exploded view of the present invention.
Figure 2:
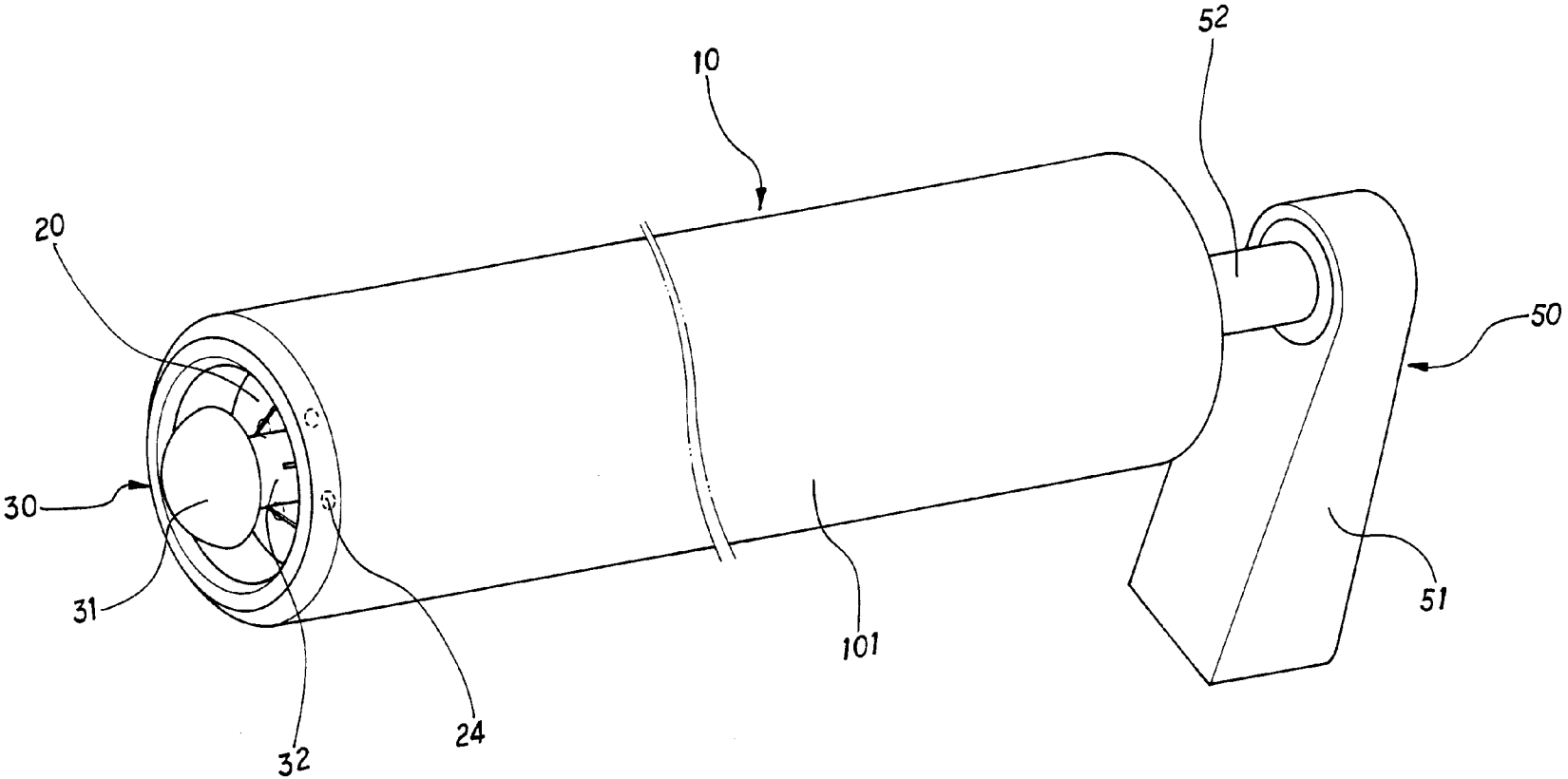
FIG. 2 is an assembly view showing the appearance of the present invention.
Figure 3:
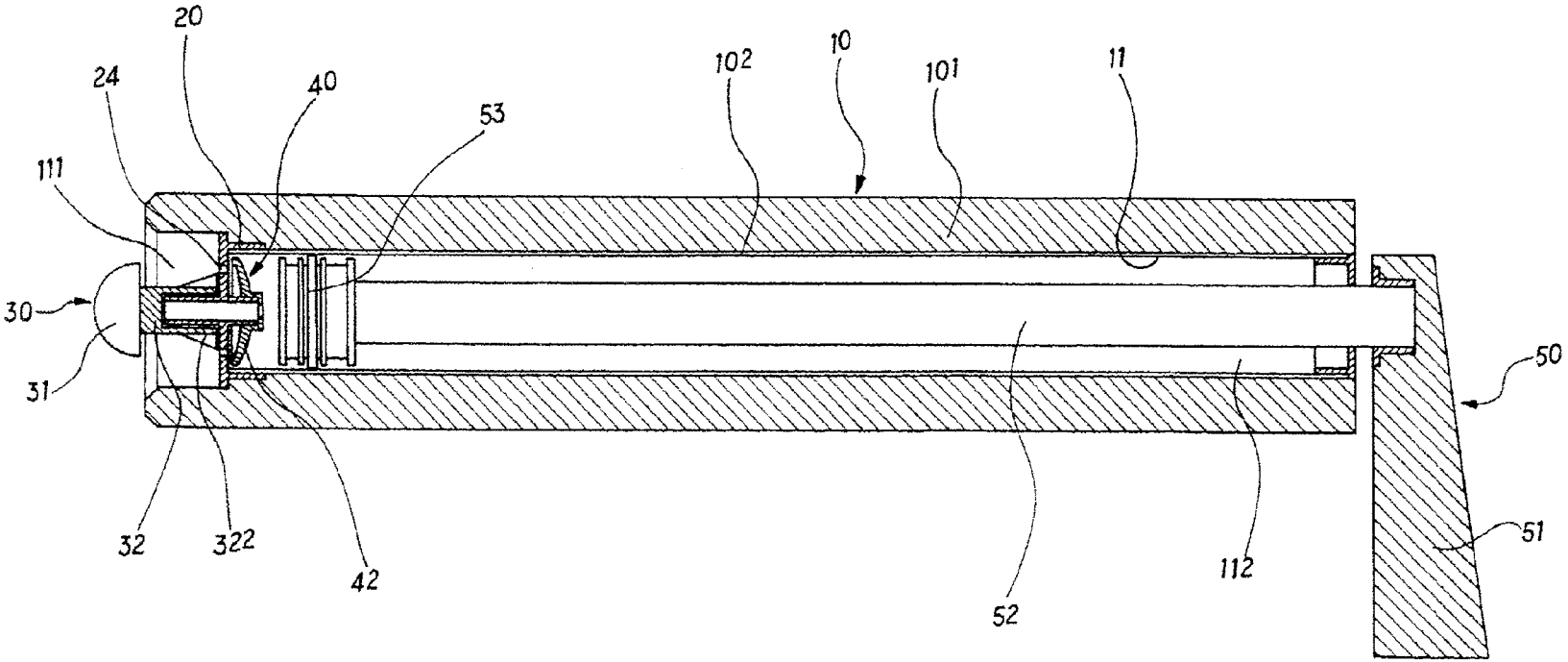
FIG. 3 is a lateral cross section view of the present invention.

First, referring to FIGS. 1 to 3, a first embodiment of an ejecting toy according to the present invention which mainly consists of a cylinder body 10, a front cover 20, an elastic object 30, a valve 40, and a handle 50 is illustrated.

The cylinder body 10 includes a tubular main body 101 made of a soft material and a tubular casing 102 made of a hard material. The tubular casing 102 is arranged on an inner wall of the main body 101 and defines a receiving chamber 11. The receiving chamber 11 has a front opening 111 and a rear opening 112.

The front cover 20 serves to cover the front opening 111 of the cylinder body 10. A front wall of the front cover 20 extends forwards so as to form a front positioning tube 21, and a rear wall of the front cover 20 extends backwards so as to form a rear positioning tube 22. A through vent hole 23 is formed between the front positioning tube 21 and the rear positioning tube 22 so as to communicate with the two positioning tubes. Between the front wall and the rear wall of the front cover 20, there are four through air inlet holes 24 are formed and located equally on the periphery.

A front portion of the elastic object 30 during flying is formed as an elastic head 31, and an elastic body 32 is extended backwards from the elastic head 31. A front end of the elastic head 31 is formed with a shape of an arc. A rear end of the elastic body 32 is formed as a positioning recess 321 for sliding into the front positioning tube 21 of the front cover 20 and covering a front end of the vent hole 23. A periphery of the elastic body 32 is formed as a plurality of wings 322 for stabilizing the flying. In the embodiment, the elastic object 30 is made of a soft material for the purpose of safety. Also, using the soft material only on the elastic head 31 will have the same effect.

Figure 4:
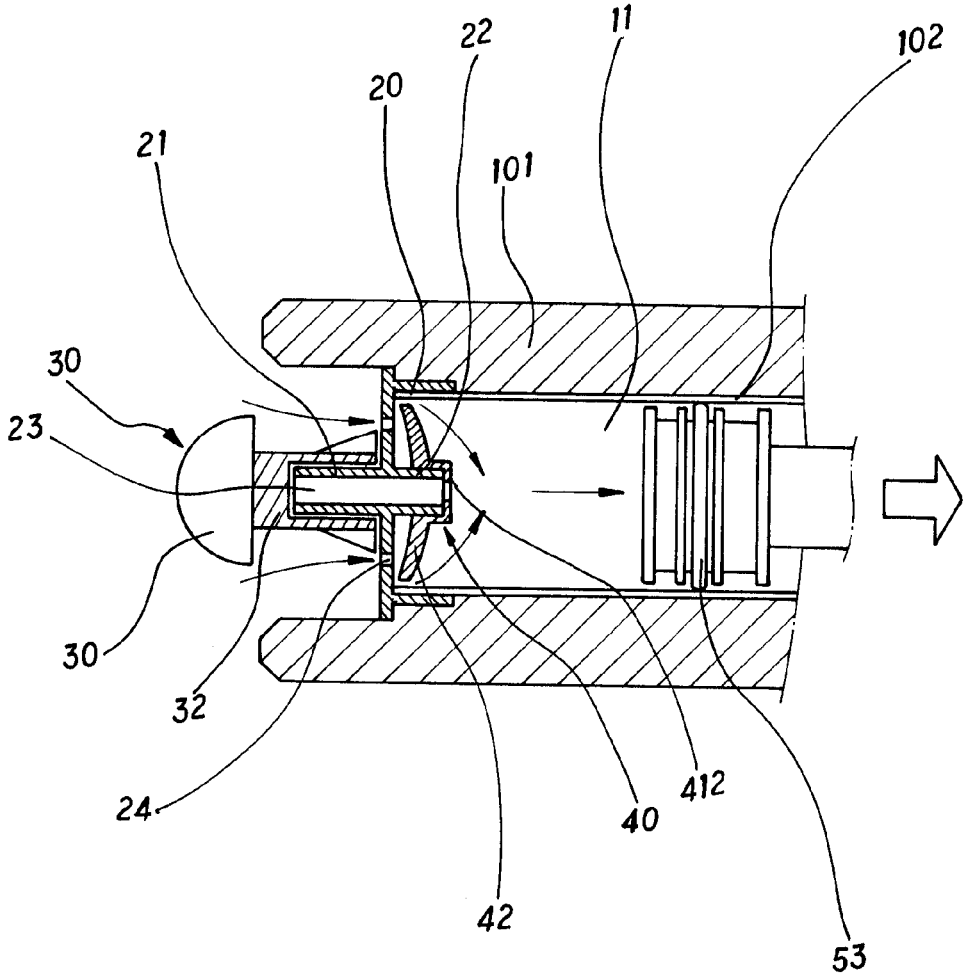
FIG. 4 is a partial lateral cross section view showing that a piston slides backwards and air flows into a receiving chamber.
Figure 5:
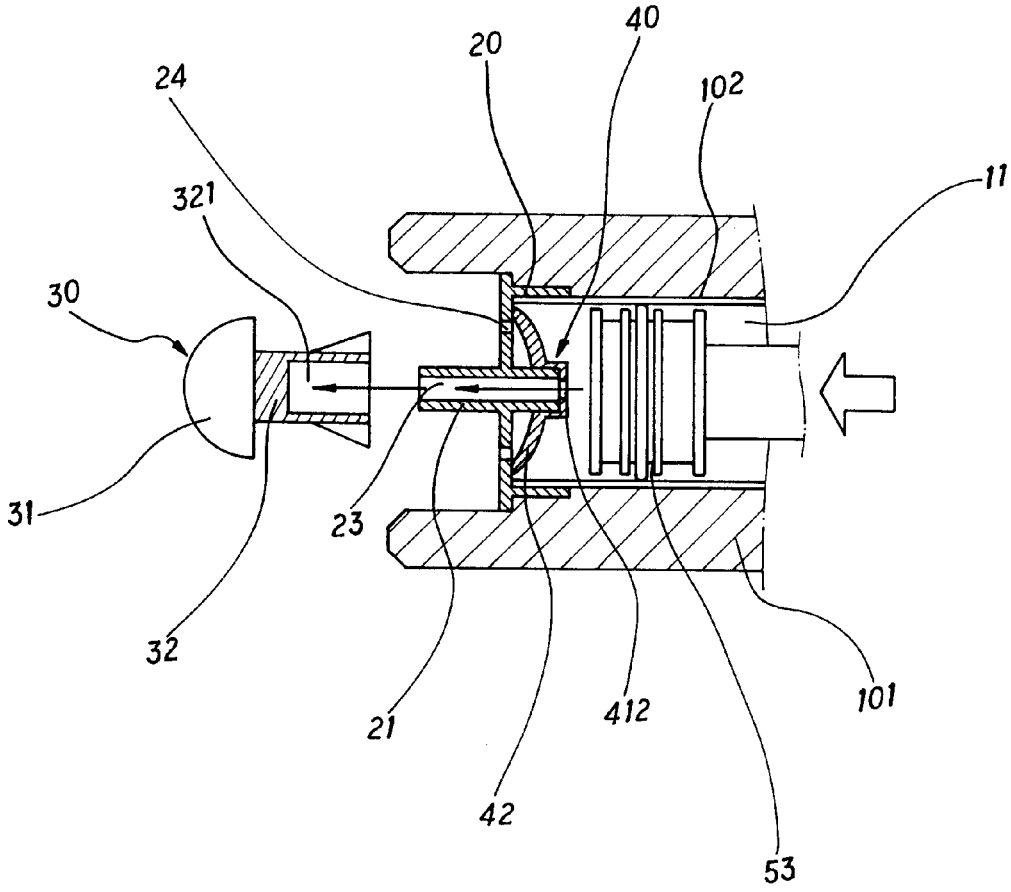
FIG. 5 is a partial lateral cross section view showing that a piston slides forwards and air is vented from a vent hole and ejects out an elastic object.

The valve 40 has an install portion 41 at a middle position thereof. The install portion 41 has a positioning slot 411 facing ahead. With reference to FIGS. 4 and 5, the positioning slot 411 can be slid into the rear positioning tube 22 of the front cover 20. A through hole 412 is formed to a bottom of the positioning slot 411 and serves to communicate with the vent hole 23 on the rear positioning tube 22 of the front cover 20. A periphery of the installation portion 41 extends a round diaphragm portion 42 with flexibility. The diaphragm portion 42 will be flexibly deformed while suffering a force to seal or unseal the air inlet holes 24 of the front cover 20.

The handle 50 has a handle portion 51 for holding by a human hand and a rod body 52 for inserting into the receiving chamber 11 from the rear opening 112 of the cylinder body 10. A front end of the rod body 52 is formed as a piston 53 for sealed sliding into the receiving chamber 11. When the handle portion 51 is pulled backwards or pushed forwards, the piston 53 will slide in the same direction with the handle portion 51 in the receiving chamber 11.

When operating the ejecting toy of the present invention, a hand holds the cylinder body 10, and another hand holds the handle portion 51 of the handle 50 and pulls it backwards to slide the piston 53 in a front end of the rod body 52 backwards along the inner wall of the receiving chamber 11. Thus, inside of the receiving chamber 11 will become a vacuum state as illustrated in FIG. 4. Meanwhile, the diaphragm portion 42 of the valve 40 will be deformed by the pressure difference and move backwards to unseal the air inlet holes 24 of the front cover 20, air will flow into the receiving chamber 11 of the cylinder body 10 through the air inlet holes 24. While the piston 53 is pulled backwards to a predetermined position and enough air is stored in the receiving chamber 11, operator can push the handle portion 51 to move the piston 53 forwards. The air in the receiving chamber 11 is pushed forwards so that the diaphragm portion 42 of the valve 40 is pushed and deformed to move forward to seal the air inlets 24 of the front cover 20 as illustrated in FIG. 5. Meanwhile, the receiving chamber 11 is completely sealed, when the piston is further pushed forwards, air in the receiving chamber 11 will be gradually pressurized and the pressure is gradually raised. When the pressure reaches a critical limit which is a resistance generated by the combination between the elastic object 30 and the front positioning tube 21 of the front cover 20, The elastic object 30 will no longer resist the force from the pressurized air from the vent hole and the receiving chamber 11 and the elastic object 30 will be ejected and flying out. The whole pull and push process is fast an easy, thus the ejecting of the elastic object is being performed in an instant. User will easily have pleasure by the ejecting and flying through the operating. Otherwise, through the wings 322 formed on the elastic body 32 of the elastic object 30, the precision of the flying is raised as well as the pleasure of the aiming and firing. Moreover, the elastic head is made of a soft material, the safety of playing is well kept. Because of the simple structure of the ejecting toy, the manufacturing and the cost is economic.

Figure 6:
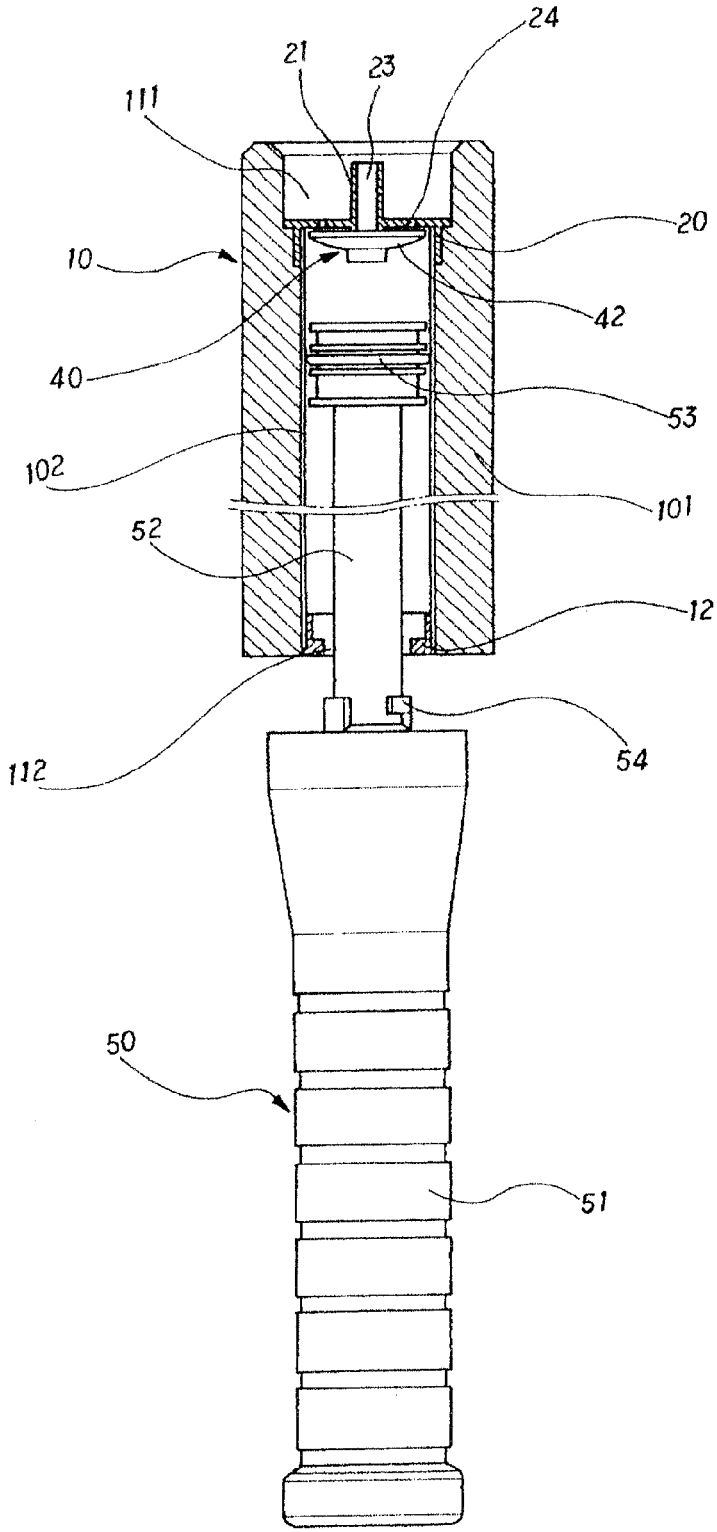
FIG. 6 is a cross section view about the second embodiment of the present invention, in that a free state between the handle and the cylinder is illustrated.
Figure 7:
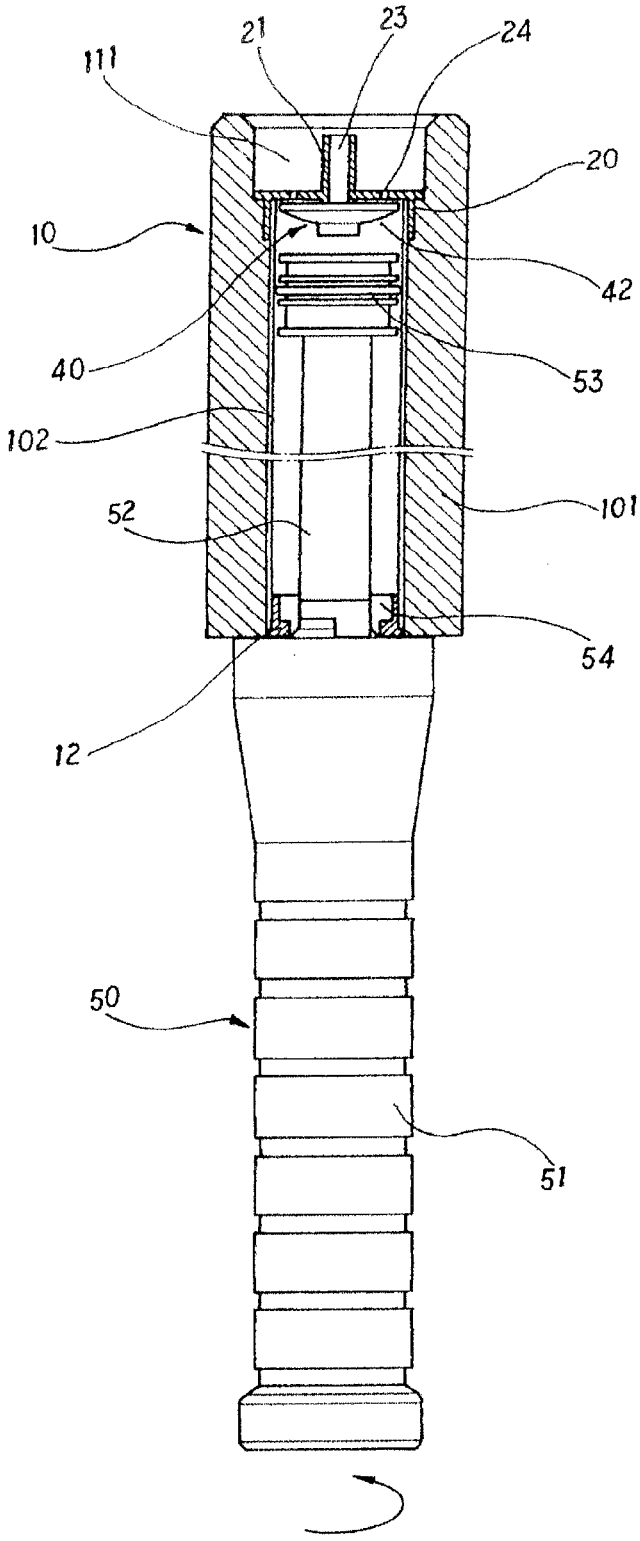
FIG. 7 is another lateral view about the toy of the present invention, where the locking state between the handle and the cylinder is illustrated.

With reference to FIGS. 6 and 7, the handle 50 has a handle portion 51. Other than above mentioned vertial arrangement of the handle portion 51 and and the rod body 52, the handle portion 51 can extend from a rear end of the rod body 52. A rear opening of the cylinder 10 is formed with a lock unit 12. A connection between the handle 50 and the handle portion 51 is formed with a lock unit 54 so as to combine the handle 50 and the cylinder 10. Thus the present invention can be used in beating and to be stored conveniently and easily.

The handle 50 has a handle portion 51 for holding by a human hand and a rod body 52 for inserting into the receiving chamber 11 from the rear opening 112 of the cylinder body 10. A front end of the rod body 52 is formed as a piston 53 for sealed sliding into the receiving chamber 11. When the handle portion 51 is pulled backwards or pushed forwards, the piston 53 will slide in the same direction with the handle portion 51 in the receiving chamber 11.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An ejecting toy comprising:

a cylinder body having a receiving chamber with a front opening and a rear opening;

a front cover being covered the front opening of the cylinder body; a front wall of the front cover being formed as a front positioning tube, and a rear wall of the front cover being formed as a rear positioning tube; a through vent hole being formed between the front positioning tube and the rear positioning tube; at least one through air inlet hole being formed on a periphery of the front cover;

an elastic object having a elastic head at a front portion thereof and an elastic body being extended backwards from the elastic head; a rear end of the elastic body being formed as a positioning recess for sliding into and covering the front positioning tube of the front cover;

a valve being slid into the rear positioning tube of the front cover and a periphery of the valve extending as a round diaphragm portion with flexibility; when suffering a force, the diaphragm portion being flexibly deformed to seal or unseal the air inlet hole of the front cover;

a handle having a handle portion and a rod body for inserting into the receiving chamber from the rear opening of the cylinder body; a front end of the rod body being formed as a piston for sealed sliding into the receiving chamber; when the handle portion being pulled backwards, the piston of the rod body sliding backwards to deform the diaphragm portion of the valve so that the diaphragm portion moves backwards to unseal the air inlet hole of the front cover and air will flow into the receiving chamber; when pushing the handle portion to move the piston forwards, the diaphragm portion of the valve deforming to move forwards to seal the air inlet hole of the front cover; meanwhile, air being vented only from the vent hole of the front cover, thus the elastic object sealed on the vent hole of the front cover being ejected out.

2. The ejecting toy as claimed in claim 1, wherein the cylinder body includes a tubular main body made of a soft material and a tubular casing made of a hard material; the tubular casing is arranged on an inner wall of the main body and defines a receiving chamber.

3. The ejecting toy as claimed in claim 1, wherein the valve has an install portion at a middle position thereof; the install portion has a positioning slot facing ahead and capable of being slid into the rear positioning tube of the front cover 20; a through hole is formed to a bottom of the positioning slot and the through hole serves to communicate with the vent hole on the rear positioning tube of the front cover; the diaphragm portion is extended from the periphery of the installation portion.

4. The ejecting toy as claimed in claim 1, wherein the handle portion of the handle is capable of being hold by a human hand.

5. The ejecting toy as claimed in claim 1, wherein at least the elastic head of the elastic object is made of a soft material.

6. The ejecting toy as claimed in claim 1, wherein the elastic head of the elastic object is formed in shape of an arc.

7. The ejecting toy as claimed in claim 1, wherein a periphery of the elastic body is extended a plurality of wings for stabilizing the flying.

8. The ejecting toy as claimed in claim 1, wherein the handle portion coaxially extended from a rear end of the rod body.

9. The ejecting toy as claimed in claim 1, wherein a rear opening of the cylinder is formed with a lock unit; and a predetermined handle portion is formed with a lock unit so as to combine the handle and the cylinder.

10. The ejecting toy as claimed in claim 1, wherein a connection between the handle and the handle portion is formed with a lock unit so as to combine the handle and the cylinder.

* * * * *